United States Patent [19]

Bardsley

[11] 4,285,170

[45] Aug. 25, 1981

[54] GRINDING OF KNIVES

[75] Inventor: Harold B. Bardsley, Euxton, Near Chorley, England

[73] Assignee: Spencer Wright Industries, Inc., Chattanooga, Tenn.

[21] Appl. No.: 137,559

[22] Filed: Apr. 4, 1980

[30] Foreign Application Priority Data

Apr. 11, 1979 [GB] United Kingdom ..... 12827/79

[51] Int. Cl.[3] ..... B24B 1/00

[52] U.S. Cl. ..... 51/288; 51/324; 76/104 R

[58] Field of Search ..... 51/285, 288, 324, 5 A; 76/101 SM, 104 R

[56] References Cited

U.S. PATENT DOCUMENTS

| | | | |
|---|---|---|---|
| 2,371,515 | 3/1945 | Gorman | 51/288 X |
| 2,710,501 | 6/1955 | Hull | 51/324 |
| 3,125,902 | 3/1964 | Blanshine | 76/104 R |
| 3,427,764 | 2/1969 | Draving | 51/324 |
| 3,461,748 | 8/1969 | Meyer | 51/288 X |

*Primary Examiner*—Gary L. Smith

*Attorney, Agent, or Firm*—Alan Ruderman

[57] ABSTRACT

A method of grinding tufting machine knife modules having a plurality of knives fixed in a common knife block in spaced parallel disposition. In a first form a remote knife of the block is secured in a fixed disposition and the other knives are loaded toward that knife with the free ends of the knives in a mutual abutment, the composite end face of all the knives thereafter being simultaneously ground to form an outwardly concave surface configuration in the composite end faces. In an alternate loading arrangement the blades on opposite sides are loaded toward the middle of the module. In a preferred arrangement the knife blades are maintained in spaced parallel disposition but collectively deflected to bring the end faces into co-planar relationship and thereafter ground in conformity with the common plane. A jig and grinding set up are illustrated for this latter arrangement.

4 Claims, 10 Drawing Figures

GRINDING OF KNIVES

BACKGROUND OF THE INVENTION

The invention concerns the grinding of knives, and has more particular reference to the grinding of knives for the loop-cutting instrumentalities of tufting machines.

In the production of cut-pile tufted fabrics, loops formed on a hook are cut as such loops move along the hook by a knife co-operable with an edge thereof.

In conventional arrangements, wherein the knives are provided as individual and separate elements, removal of the knives for grinding when the same become blunt is readily effected simply by removing the individual knives from the knife-blocks, regrinding the cutting edge and again mounting the knives in the related knife-blocks.

However, it is now commonplace to provide the knives in modular form, a plurality of individual knives being cast integrally in a common body whereby the knives are supported on a knife bar, a typical module including ten knives arranged in closely-spaced parallel disposition.

While the use of a modular concept in the context of the tuft-forming instrumentalities of a tufting machine does offer advantages over the more conventional arrangements wherein the needles, hooks and knives were all provided as individual elements separately mounted on the tufting machine, especially in the area of fine gauge tufting machines, particular difficulty is experienced in connection with the regrinding of the individual knives of a knife module having regard to the close disposition of adjacent knives.

SUMMARY OF THE INVENTION

The primary object of the invention is to provide a method for the ready grinding of the individual knives of a plurality thereof mounted in a common knife block as an integral part thereof.

According to one aspect of the present invention there is proposed a method of grinding the respective cutting edges of a plurality of tufting machine knives formed integrally with a common knife block which method includes the steps of supporting a selected one of the said knives in a fixed disposition, loading the remaining knives towards the said selected knife with the respective free ends of the knives in mutual abutment of the cutting edges in side-by-side disposition in the longitudinal direction of the knife blades, grinding the composite end face of the plurality of knives thereby simultaneously to grind the individual knives, and subsequently removing the loading from the blades to allow the same to revert to their initial relative positions.

According to a preferred feature the selected knife against which the remaining free knife ends are loaded into abutment comprises a remote knife of the plurality of knives provided in the common knife block.

According to a further preferred feature, the grinding operation forms an outwardly concave surface configuration in the composite end face of the abutting knife ends.

According to another aspect of the invention there is proposed a method of grinding the respective cutting edges of a plurality of tufting machine knives formed integrally with a common knife block, which method includes the steps of locating the individual knives in a predetermined space relative disposition, collectively deflecting the knives laterally while maintaining the same in the said spaced disposition, to bring the end faces substantially into a common plane, grinding the said end faces into conformity with said common plane, and releasing the said knives.

Preferably a spacer means is introduced between the adjacent ones of the plurality of knives, and is maintained in position therebetween during the deflecting and grinding steps.

The invention also includes a grinding fixture including a support means to receive and support the module with the knives thereof accessible for grinding, and a spacer means engageable with the knife blades to support the same in predetermined spaced disposition, the said fixture including means adapted and arranged to effect a lateral shift of the knives while maintaining the predetermined spacing thereof.

BRIEF DESCRIPTION OF THE DRAWINGS

The invention will now be described further, by way of example only, with reference to the accompanying diagrammatic drawings in which.

DESCRIPTION OF THE PREFERRED EMBODIMENTS

Figure 1:
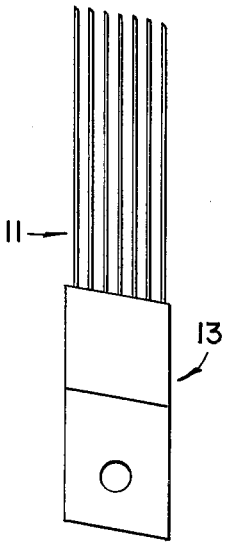
FIG. 1 is a front elevation of a knife module.
Figure 2:
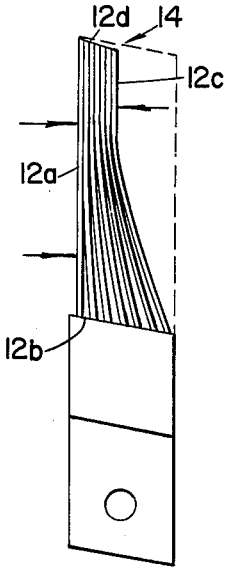
FIG. 2 illustrates the loading of the blades into abutting disposition against a remote one of such blades in accordance with a first embodiment of the invention.

Referring now to the drawings, and particularly to FIGS. 1 to 5 thereof, in the simultaneous grinding of the blades of a tufting machine knife module 11 comprising a multiplicity, say ten, of knife blades 12 arranged in spaced parallel disposition in a common knife block 13 and cast integrally with the block, the extreme knife blade 12*a* is secured in position in a suitable jig and the remaining blades 12*b* are loaded by tension towards the fixed blade 12*a* such that the end regions 12*c* of the respective blades move into abutment and are supported against the fixed blade, the extremities 12*d* of the individual blades being in slightly offset disposition in the longitudinal direction of the blades to give a stepped composite end face 14 to the abutting blades as shown in FIG. 2, the cutting edges of the individual blades being at the intersection of one of the elongated side faces and the end face 14, the latter being ground at a slight angle relative to the former.

Figure 3:
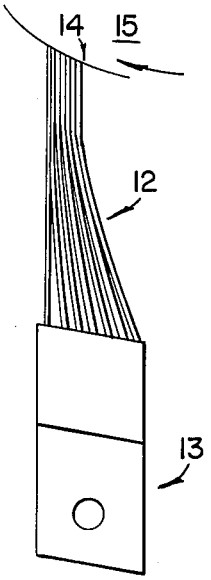
FIG. 3 represents the grinding of the blade ends.
Figure 4:
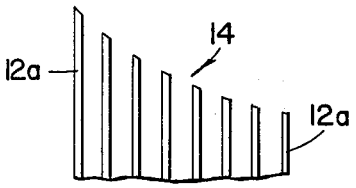
FIG. 4 is an enlarged scrap view and shows the blade ends in abutting disposition after the grinding step.

The composite end face 14 of the abutting blades is ground, as indicated in FIG. 3, to give a face of outwardly concave cylindrical form, a symmetrical disposition of the rotational axis of the grinding tool 15 providing for a like angle of inclination of the respective end faces of the individual blades and thus ensuring uniformity of cutting edge for the different blades.

Figure 5:
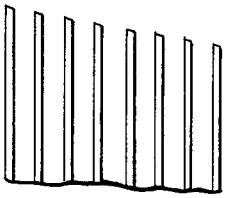
FIG. 5 is an enlarged scrap view of some of the blade ends of FIG. 4 with the individual blades in their released positions.

On release of the blades from their position of abutment with the extreme knife blade, such blades revert to their normal spaced parallel disposition by virtue of the resilience of the spring steel blades, the like character of the individual cutting edges being apparent from FIG. 5.

Figure 6:
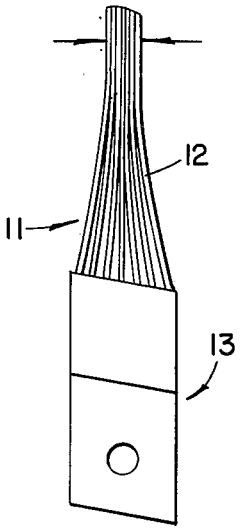
FIG. 6 is a view corresponding to FIG. 2 and shows an alternative loading arrangement for the blade ends.

As an alternative to moving the blades into abutment with an extreme one of the blades to assume the disposition shown in FIGS. 2 and 3, it may be found preferable to move the blades into abutment by loading such blades from opposite sides to clamp the same in relation to a notional plane of symmetry passing through the module and parallel to the respective planes of the individual blades when in a relaxed state, and to grind the composite end face of the stack of blades, a typical such arrangement being shown in FIG. 6.

While, in the ordinary course of events, the grinding step will involve the use of a plain grinding wheel, it may be preferred in some instances, as for example when following the procedure illustrated by FIG. 6, to use a contoured grinding wheel.

Figure 7:
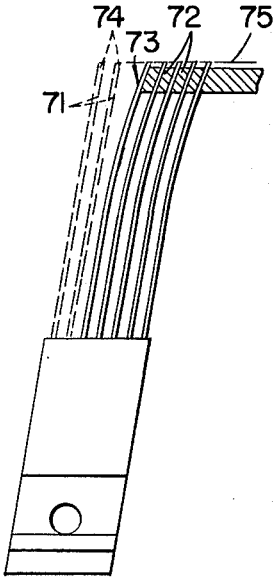
FIG. 7 is a diagrammatic front elevation of an alternative method for effecting deflection of the knife blades and grinding of the cutting edges thereof.
Figure 8:
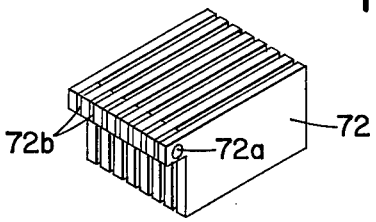
FIG. 8 is a diagrammatic perspective view of a spacer means suitable for use in the context of the method illustrated by FIG. 7.
Figure 9:
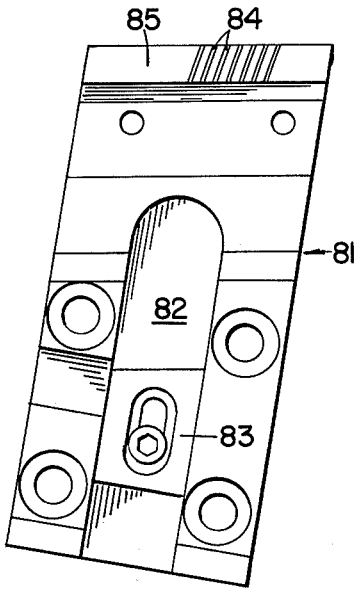
FIG. 9 is an elevational view of a spacer jig for use in the method of FIG. 7.

In a still further, and preferred, alternative, see now FIGS. 7 and 8, the individual knife blades 71 are maintained in a spaced parallel disposition consistent with the normal spacing of the blades by means of spacers 72 interposed therebetween, and prior to grinding the blades are collectively deflected by application of a transverse loading 73 thereto to bring the respective end faces 74 of the individual blades 71 into substantially co-planar relationship. The end faces 74 are then flat ground consistent with the common plane 75, the transverse loading 73 is relieved and the spacers 72 are removed. The spacers may take a variety of forms, a typical spacer arrangement being shown diagrammatically in FIG. 8 and comprising a plurality of individual spacer elements 72 of generally rectangular form pivotally supported in spaced parallel disposition on a pin 72*a* and maintained in such disposition by spacing washers 72*b*. Preferably the spacer elements 72 are fabricated from a flexible material such as nylon, in order that such elements will accommodate deflections in the blades during loading thereof. Another spacer for performing the method of FIGS. 7 and 8 is illustrated by the jig 81 in FIG. 9. The jig 81 has a knife block receiving portion 82 and the knife block is secured in place by a clamping member 82 bolted in place after the blades 71 are positioned within parallel slots 84 cut in a block 85 at the front of the jig. The slots 84 are offset from the knife block receiving portion 82 relatively to the blades and the knife block so that the blades are tensed and deflected collectively to bring the end faces 74 of the blades 71 into substantially co-planar relationship for grinding.

Figure 10:
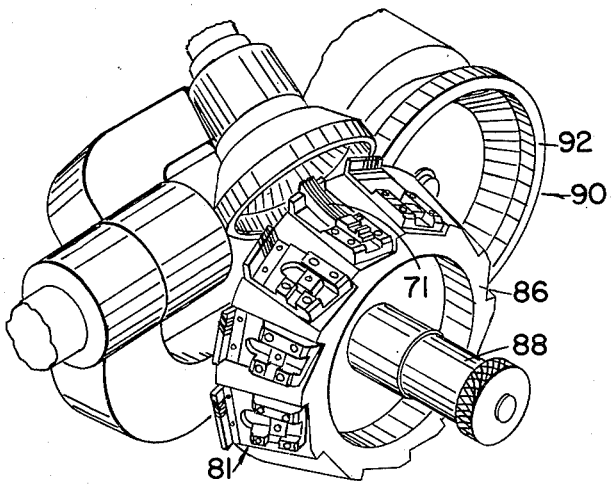
FIG. 10 is a portion of a grinding set-up using the jig illustrated in FIG. 9.

FIG. 10 shows a grinding set up using a plurality of jigs 81 mounted about the periphery of a substantially cylindrical mandrel 86. The mandrel can be mounted on an indexed shaft 88 of a grinder 90 having a grinding wheel 92 acting against the end faces 74 of the blades. Rather than mounting the jigs on a cylindrical mandrel they may be mounted in a line on a flat bed and the end faces ground by a surface grinder.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A method of grinding the cutting edges of a plurality of spaced substantially parallel elongated tufting machine knife blades having a mounting portion carried in cantilever fashion in a common knife block, the cutting edges being on the free end of the blades oppositely disposed to the mounting portion, said method comprising locating the individual knife blades in a predetermined spaced relative disposition, collectively deflecting the blades laterally while maintaining the spaced disposition to bring the free ends substantially into a common plane, grinding the free ends into conformity with said common plane, and releasing the deflection from the blades.

2. The method as recited in claim 1 wherein said locating of said blades in predetermined disposition is performed by inserting a spacer between each pair of adjacent blades.

3. The method as recited in claim 1 wherein said deflecting of said blades comprises bending said blades relatively to said knife block.

4. The method as recited in claim 1 wherein said location of said blades in spaced disposition and said deflecting of said blades comprises inserting said knife block in a jig having spaced slots for receiving each blade, said spaced slots being offset relatively to said block more than said blades are offset from said block prior to deflection, and securing said block in said jig.

* * * * *